US005823934A

United States Patent [19]

Ferrone

[11] Patent Number: 5,823,934

[45] **Date of Patent: *Oct. 20, 1998**

[54] AUTOMATIC TRIMMING MACHINE WITH SPLIT ROTARY KNIFE ASSEMBLY

[76] Inventor: Rock A. Ferrone, 1885 Main St., Pittsburgh, Pa. 15215

[ * ] Notice: The term of this patent shall not extend beyond the expiration date of Pat. No. 5,338,282.

[21] Appl. No.: 448,616

[22] PCT Filed: Mar. 22, 1994

[86] PCT No.: PCT/US94/03032

§ 371 Date: Oct. 20, 1995

§ 102(e) Date: Oct. 20, 1995

[87] PCT Pub. No.: WO94/21464

PCT Pub. Date: Sep. 29, 1994

Related U.S. Application Data

[63] Continuation-in-part of Ser. No. 35,462, Mar. 23, 1993, Pat. No. 5,338,282.

[51] Int. Cl.[6] ..... B41F 13/56

[52] U.S. Cl. ..... 493/342; 493/357; 493/359; 83/665

[58] Field of Search ..... 493/342, 357, 493/359, 356, 358, 360, 355, 366; 83/499, 503, 504, 665, 838, 666, 676, 564; 270/21.1

[56] References Cited

U.S. PATENT DOCUMENTS

| | | | |
|---|---|---|---|
| Re. 3,101 | 8/1968 | Hayes et al. . | |
| 469,543 | 2/1892 | Cook . | |
| 1,658,466 | 2/1928 | Sheldon | 493/357 |
| 1,830,416 | 11/1931 | Wood | 493/357 |
| 1,831,246 | 11/1931 | Hitchcock | 493/342 |
| 2,572,802 | 10/1951 | Crabtree et al. | 493/342 |
| 2,781,095 | 2/1957 | Spinner | 493/342 |
| 3,685,820 | 8/1972 | Surbrook | 493/360 |
| 3,784,187 | 1/1974 | Takayanagi et al. | 493/359 |
| 3,799,536 | 3/1974 | Gregoire | 493/342 |
| 3,843,113 | 10/1974 | Schaffer | 493/357 |
| 3,992,614 | 11/1976 | Buss | 235/151.1 |
| 4,010,677 | 3/1977 | Harikawa . | |
| 4,072,887 | 2/1978 | Buschmann et al. | 318/675 |
| 4,077,291 | 3/1978 | Obenshain | 83/499 |
| 4,102,227 | 7/1978 | Simko | 83/7 |
| 4,116,098 | 9/1978 | Suzuki et al. | 83/425.4 |
| 4,252,044 | 2/1981 | Yamashita et al. | 83/499 |
| 4,570,517 | 2/1986 | Souza | 83/666 |
| 4,584,920 | 4/1986 | Jansen-Herffeld | 83/838 |
| 4,607,552 | 8/1986 | Siler | 83/71 |
| 4,649,782 | 3/1987 | Cavagna | 83/425.4 |
| 4,657,428 | 4/1987 | Wiley | 403/359 |
| 4,702,134 | 10/1987 | Corley, III | 83/71 |
| 4,732,083 | 3/1988 | Arter | 83/665 |
| 4,781,668 | 11/1988 | Mowry | 493/365 |
| 5,072,641 | 12/1991 | Urban et al. | 83/499 |
| 5,097,732 | 3/1992 | Tahara | 83/76.001 |
| 5,125,301 | 6/1992 | Miller et al. | 83/13 |
| 5,170,688 | 12/1992 | Keech et al. | 493/342 |
| 5,309,962 | 5/1994 | McCord | 83/664 |

FOREIGN PATENT DOCUMENTS

| | | | |
|---|---|---|---|
| 2455513 | 1/1981 | France | 270/21.1 |
| 2513244 | 10/1975 | Germany | 493/359 |

*Primary Examiner*—John Sipos
*Assistant Examiner*—Christopher W. Day
*Attorney, Agent, or Firm*—Webb Ziesenheim Bruening Logsdon Orkin & Hanson, P.C.

[57] ABSTRACT

The automatic trimming machine of the present invention utilizes a conventional web press to print various sizes of postal and insert cards, flyers and coupon books completely on-line. The automatic trimming machine of the present invention includes a device (12) for perforating the paper to define a folding line (14) and a paper folding device (16) for folding the paper along the perforated folding line. A preliminary trimming unit will first trim the left and right sides of the folded paper, including removing the backbone of the folded paper. The severed backone is then removed from the preliminary trimming unit. The top and bottom edges of the paper are then trimmed to the appropriate size prior to the paper being cut into distinct products in a finish trimming unit. The finish trimming unit includes a plurality of adjustable cutting blades to allow for cutting of various sized products.

11 Claims, 7 Drawing Sheets

AUTOMATIC TRIMMING MACHINE WITH SPLIT ROTARY KNIFE ASSEMBLY

This is a continuation-in-part of U.S. patent application Ser. No. 08/035,462 filed Mar. 23, 1993, now U.S. Pat. No. 5,338,282.

BACKGROUND OF THE INVENTION

1. Field of the Invention

The present invention relates to automatic trimming machines for web presses and a knife blade assembly therefor, more specifically, toward the manufacture of various sizes of postal cards, insert cards, flyers, coupon books and the like in an on-line process using an automatic trimming machine which may include split rotary knife assemblies.

2. Prior Art

The existing processes for printing and cutting small postal cards and the like involve a separate process for cutting the cards after they have been printed. The prior art process involves slitting the paper on a web press into sheets. The slit sheets are then removed from the web press and cut in a separate process. This two step process is somewhat labor-intensive and time-consuming.

Additionally, the changing and servicing of knife assemblies in prior art systems have been labor-intensive. Replacing or servicing an integral blade of knife assemblies may take up to four hours due to the disassembly required to remove the integral blade from the supporting shaft or hub. Split blade assemblies have been developed for use in various areas which can reduce some of these problems. Examples of known split blade assemblies are found in U.S. Pat. Nos. 3,850,069; 3,899,955; 4,570,517 and 4,584,920.

The object of the present invention is to overcome the aforementioned drawbacks of the prior art. A further object of the present invention is to provide an automatic trimming machine for use with a web press which allows the press to cut various sized postal and insert cards, flyers, coupon books and the like in a single on-line process. A further object of the present invention is to provide a split ring knife blade assembly for automatic trimming machines and the like which provides for quick replacement of the knife blade.

SUMMARY OF THE INVENTION

The present invention provides an automatic trimming machine for use with a web press which is adapted to cut various sizes of postal and insert cards, flyers, coupon books and the like in a single continuous on-line process. The automatic trimming machine of the present invention includes a paper perforation wheel installed on a trolley of a web press. The paper perforation wheel perforates a web of paper along a folding line. The web press will sever the web of paper into individual sheets of paper in a conventional fashion. A paper folding device will fold the sheets of paper along the folding line forming a backbone along a first side of the folded paper.

The folded paper will then proceed to a preliminary trimming unit which trims the folded paper. The preliminary trimming unit includes a first, a second, a third and a fourth knife. The first knife is positioned on a second side of the folded paper for cutting the folded paper to a specified size. The second knife is positioned on the first side of the folded paper for cutting the backbone from the folded paper. The third and fourth knives are positioned to trim the top edge and bottom edge, respectively, from the folded paper. A vacuum removal device is positioned above the second knife for removing the severed backbone. In one embodiment, the knife assemblies of the preliminary trimming unit may be automatically, individually adjustable.

The paper is then cut into distinct final products in a finish trimming unit. In one embodiment, the finish trimming unit represents a separate device which can be attached to the end of a conventional three knife trimmer or similar device. The finish trimming unit includes a frame, with a feeding mechanism mounted on the frame for transporting material to be cut through the finish trimming unit. A lower knife shaft is mounted on the frame below the path of the material through the finish trimming unit, with a plurality of lower knife blades attached to the lower knife shaft at spaced locations. An upper knife shaft is mounted on the frame above the path of the material, with at least one upper knife blade adjustably positioned on the upper knife shaft. A driving mechanism for driving both the upper knife shaft and the lower knife shaft is provided. Additionally, the finish trimming unit includes a knife positioning device for positioning the upper knife blades along the upper knife shaft to cooperate with selective lower knife blades of the plurality of lower knife blades to form at least one knife pair which is adapted to cut the material.

The knife assemblies may include a knife blade with two separable interlocking sections. The knife positioning device of the finish trimming unit may include at least one pneumatic cylinder attached to the upper knife shaft and adapted to lift the upper knife shaft to a knife adjustment position, with at least one pneumatic cylinder attached to each of the upper knife blades to adjust the position of the upper knife blade on the upper knife shaft when the upper knife shaft is in the knife adjustment position. In a preferred embodiment of the present invention, the knife positioning device includes a pair of pneumatic cylinders attached to each upper knife blade, with the pair of pneumatic cylinders attached to each upper knife blade on opposed sides of the upper knife shaft. The pneumatic cylinders attached to the upper knife blade are also adapted to maintain an engagement pressure on each upper knife blade during the cutting of the material to maintain engagement between the upper knife blade and the cooperating lower knife blade. All of the pneumatic cylinders may be controlled by a central controller to automate the process.

These and other advantages of the present invention will become apparent in the description of the preferred embodiments in connection with the attached figures, wherein like reference numerals represent like items throughout.

DESCRIPTION OF THE PREFERRED EMBODIMENTS

Figure 1:
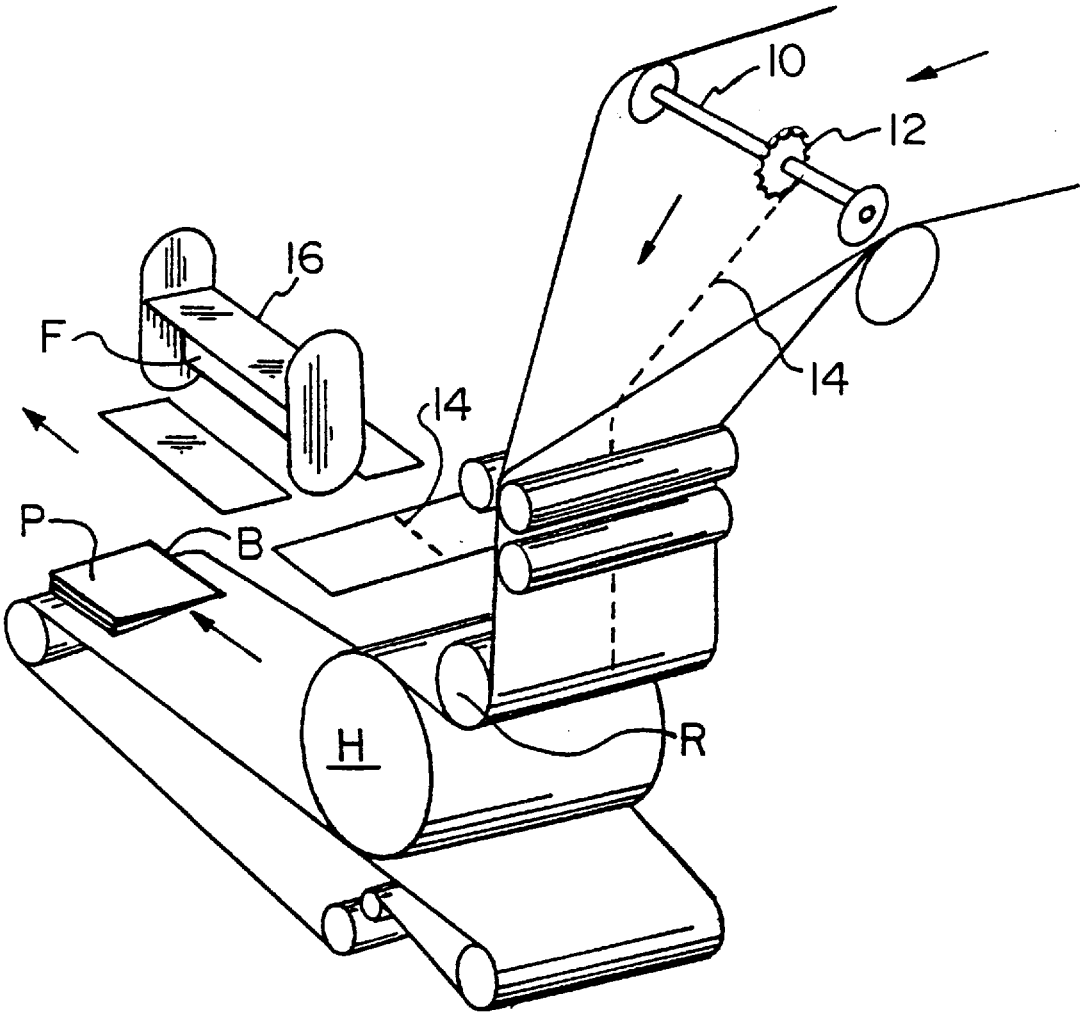
FIG. 1 schematically illustrates a perforating wheel and folding device of an automatic trimming system according to the present invention.

The automatic trimming machine of the present invention allows a conventional web press to cut various sized postal and insert cards, flyers, coupon books and the like in a single on-line process. An important element of the present invention is the perforation process which provides a needed perforated fold line 14 to enable the web of paper to be precisely folded and trimmed. The present invention replaces the slitting wheel (not shown) located on a trolley 10 of an otherwise conventional web press with a precisely positioned and machined perforation wheel 12, shown in FIG. 1. The perforation wheel 12 is preferably a machined, stainless steel perforation wheel. Perforation wheel 12 places a perforation in the web of paper along a fold line 14. Perforation of the fold line 14 allows for precise folding of the web of paper and for appropriate trimming of the sheets of paper P, as will be described hereinafter. The perforated web of paper is fed through the web press in the conventional fashion. In the web press, a half drum H cooperates with a roller R to pull the perforated web through the web press and separate the web into sheets of paper P, such as by a cutter blade (not shown) on the roller R. The paper P will have the perforation along the fold line 14 at the centerline thereof. The perforated sheet of paper P is then fed to a conventional folding unit 16 with folding blade F which will fold the paper P along fold line 14 forming a backbone, or spine, B on one side of the folded paper P. The backbone B is the back of the book or magazine where the pages are connected. With the exception of the perforation wheel 12, the above-described elements of the web press, including the half drum H, the roller R, cutter blade (not shown) and the folding unit 16 with a folding blade F, are conventional elements well-known in the art operating in a conventional fashion.

Figure 2:
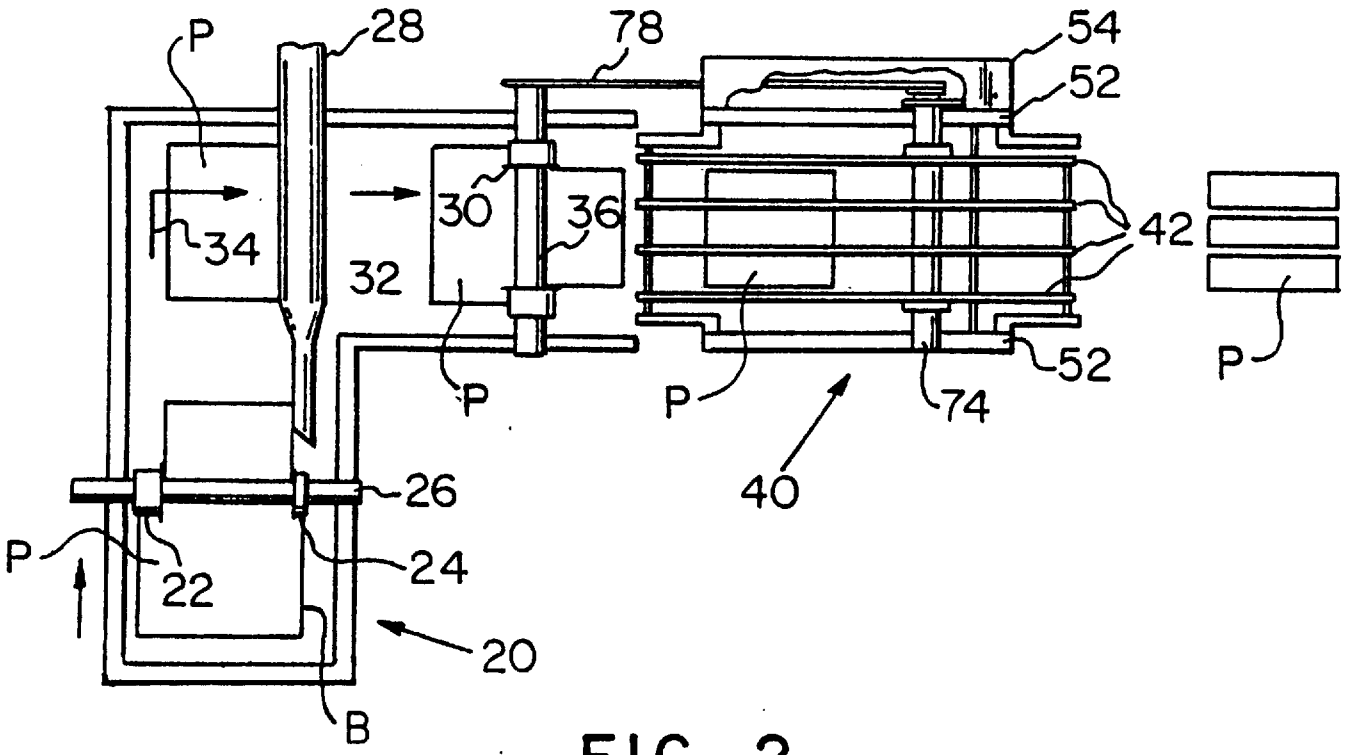
FIG. 2 schematically illustrates a top view of a preliminary trimming unit and a finish trimming unit of the automatic trimming system according to a first embodiment of the present invention.

The folded paper P is fed to a preliminary trimming unit 20, shown in FIG. 2. The preliminary trimming unit includes a first knife 22 for trimming the left side of the folded paper P to a specified size. The left side of the folded paper P is opposite the backbone B formed by the folding unit 16, as shown in FIG. 2. The preliminary trimming unit 20 includes a second knife 24 adapted to sever the backbone B of the folded paper P. Both the first knife 22 and the second knife 24 may be formed as a pair of split ring stainless steel rotary knife assemblies positioned above and below the paper to be severed. A preferred knife assembly is discussed below in connection with FIGS. 6A–6E. The upper blades of the first knife 22 and the second knife 24 may be mounted on a single upper blade shaft 26. The lower knife blades of the first knife 22 and the second knife 24 can be mounted on a single lower blade shaft (not shown) mounted below the paper to be severed. Either or both of the upper blade shaft 26 and the lower blade shaft (not shown) may be driven in a conventional fashion.

The cutting of the backbone B of the paper P by the second knife 24 presents some difficulties because of the subsequent need to remove the severed backbone B. The rigidity of the severed backbone B prevents the waste backbone B from being removed by a conventional suction waste removal system (not shown) which is positioned below the preliminary trimming unit 20. A vacuum device is positioned above the second knife 24 for removing the severed backbone B. The vacuum device includes a plastic tube assembly 28 attached to a vacuum source (not shown) for removing the severed backbone B from above the second knife 24. The plastic tube assembly is positioned at an angle of less than 45° with respect to the horizontal. Additionally, the connections and the ends within the tube assembly 28 are less than 45° . This arrangement eliminates clogging within the plastic tubing and facilitates the removal of the severed backbone B. Furthermore, the perforation wheel 12 places perforations along the fold line 14, as described above. These perforations introduce a sufficient amount of flexibility into the backbone B to allow the severed backbone B to be removed through the plastic tube assembly 28.

The preliminary trimming unit 20 further includes a third knife 30 and a fourth knife 32 which are adapted to sever the top and bottom edges of the folded paper P, respectively. A 90° change in the direction of the transportation of the paper P to be trimmed by the preliminary trimming unit 20 is shown by arrow 34 and occurs between the second knife 24 and the third knife 30. The third knife 30 and the fourth knife 32 may be similar to the first knife 22 and the second knife 24, each including a pair of split ring stainless steel rotary knife assemblies positioned above and below material to be trimmed. The upper knife blades of the third knife 30 and the fourth knife 32 can be mounted on a single upper knife shaft 36 which can be driven in a conventional fashion. The lower knife blades (not shown) of the third knife 30 and the fourth knife 32 may be mounted and driven in a similar fashion.

The preliminary trimming unit 20 of the present invention represents a modification of an existing three knife trimming unit. The existing three knife trimming unit basically includes a first knife for trimming the left side of the paper similar to the first knife 22, a second knife for trimming the top of the paper similar to the third knife 30 and a third knife for trimming the bottom of the paper similar to the fourth knife 32. The right side of the folded paper in a conventional three knife trimmer is normally left intact to maintain the backbone connection for the newspaper or magazine. Consequently, the existing three knife trimmer does not provide a backbone removing knife (second knife 24) or a backbone removing mechanism (plastic tube assembly 28).

The trimmed paper P is then fed from the preliminary trimming unit 20 into a finish trimming unit 40 which will cut the paper P into specified sizes appropriate for the finished product, as will be described hereinafter.

Figure 3:
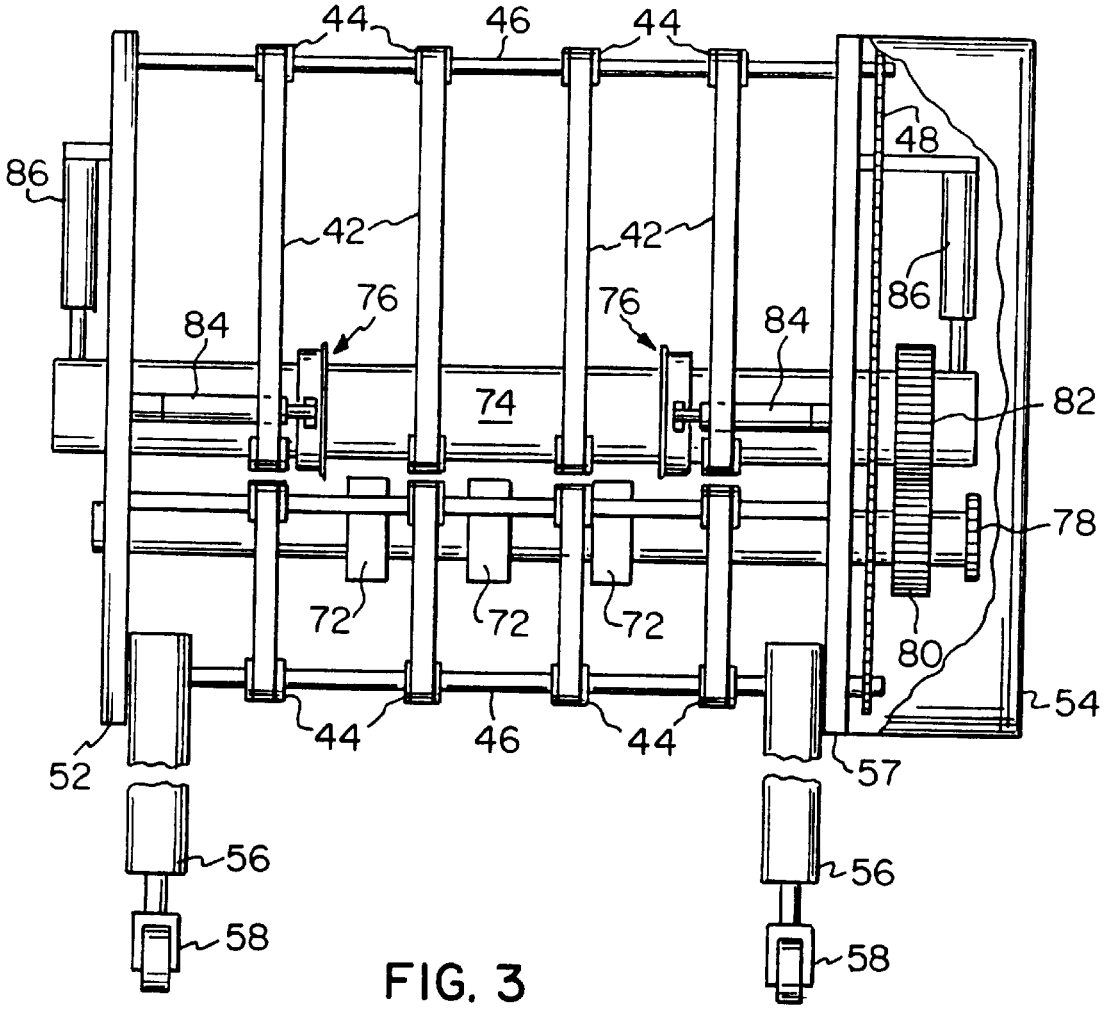
FIG. 3 is a front view of the finish trimming unit of FIG. 2.
Figure 4:
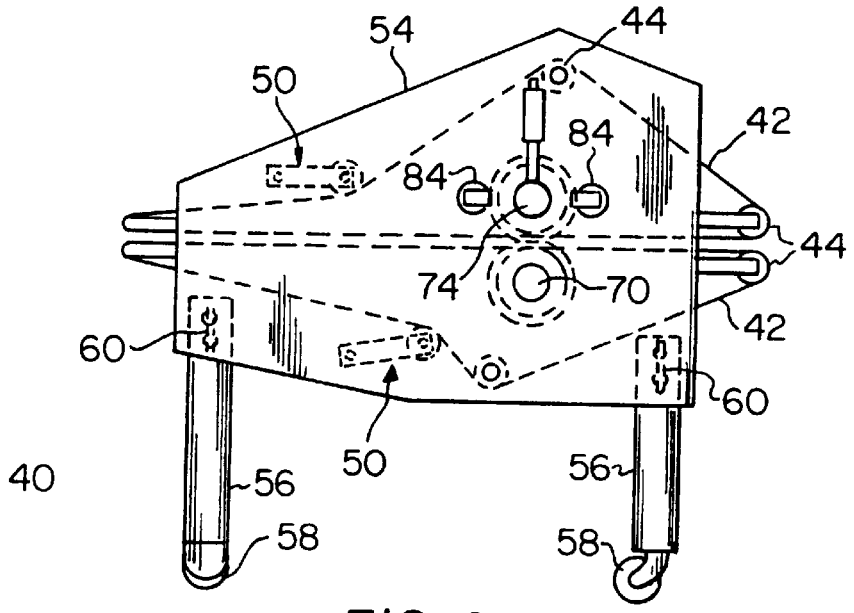
FIG. 4 is a side view of the finish trimming unit of FIGS. 2 and 3.

The paper P to be severed is transported through the finish trimming unit 40 by four pairs of spaced upper and lower nylon drive belts 42. As shown in FIG. 3, each of the drive belts 42 is reeved around a plurality of pulleys 44 coaxially mounted on shafts 46. The shafts 46 can be appropriately driven by a first drive chain 48 appropriately connected to a source of driving power. As shown in FIG. 4, each drive belt 42 includes an appropriate pivotable tensioning roller 50.

As shown in FIG. 3, the frame of the finish trimming unit 40 includes a pair of opposed side frames 52 which support the shafts 46 for the drive belts 42. A protective cover 54 is attached to one of the side frames 52 to protect the enclosed driving assemblies. The side frames 52 are supported by leg members 56 which rest on rollable casters 58. Each of the leg members 56 includes a height adjusting slotted bolt connection 60 to provide for appropriate adjusting of the height of the finish trimming unit 40.

As shown in FIG. 3, the finish trimming unit 40 includes a lower knife shaft 70 mounted between the side frames 52. The lower knife shaft 70 includes three spaced lower rotary knife blades 72 attached at spaced locations to the lower knife shaft 70. The lower knife blades 72 are preferably stainless steel rotary wheels which are keyed to the lower knife shaft 70. These blades 72 are spaced such that the outer lower knife blades 72 will effectively divide the paper being cut into thirds while the center lower knife blade 72 will divide the material being cut substantially in half.

An upper knife shaft 74 extends between the side frames 52. The upper knife shaft 74 slidably receives a pair of upper rotary knife blades 76. The upper rotary knife blades 76 are keyed to the upper knife shaft 74.

The lower knife shaft 70 is driven by a second drive chain 78 which can be coupled to the shaft 36 for the third knife 30 and fourth knife 32, as shown in FIG. 2. Alternatively, the second drive chain 78 can be driven in any other conventional fashion.

The driving of lower knife shaft 70 will drive the lower knife blades 72 which are keyed thereto. Meshing steel gears 80 and 82 are provided on the lower knife shaft 70 and the upper knife shaft 74, respectively, for driving of the upper knife shaft 74. The driving of the upper knife shaft 74 will forcibly drive the upper knife blades 76 which are keyed thereto.

Figure 5:
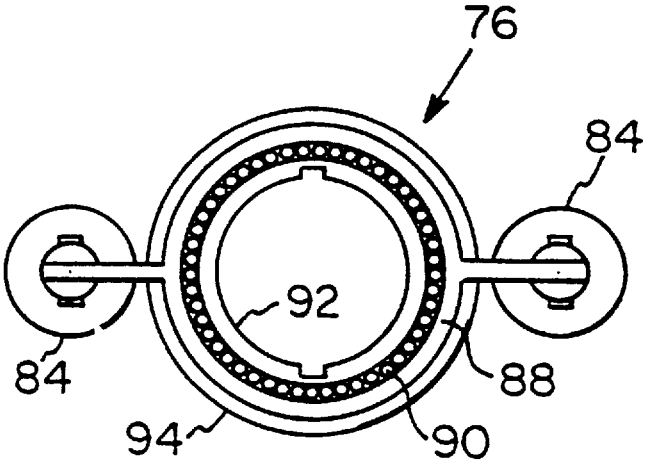
FIG. 5 is an enlarged side view of an upper blade arrangement of the finish trimming unit shown in FIGS. 2–4.

As shown in FIGS. 3–5, each upper knife blade 76 is slidably positioned on the upper knife shaft 74 by a pair of pneumatic cylinders 84 positioned on opposed sides of the upper knife shaft 74. Lifting pneumatic cylinders 86 are attached to opposed sides of the upper knife shaft 74 to provide for lifting of the upper knife shaft 74 into a knife adjustment position. The knife adjustment position allows for the pneumatic cylinders 84 to position the upper knife blade 76 without interfering with the drive belts 42. Furthermore, in operation, the pneumatic cylinders 86 of each of the upper knife blades 76 are adapted to maintain an engagement pressure on the upper knife blades 76 during the cutting of the paper to maintain engagement between the upper knife blade 76 and an associated lower knife blade 72.

FIG. 5 illustrates a more detailed view of the upper knife blades 76. Knife blade 76 includes an attaching assembly 88 attaching to the pneumatic cylinders 84. The attaching assembly 88 is separated by a bearing assembly 90 from the rotary knife housing 92. The rotary knife housing 92 includes notches for being keyed to the upper knife shaft 74 and directly supports the rotary knife 94. The upper rotary knives 94 are preferably stainless steel rotary knives ground to a sharp finish. The rotary knife 94 may be formed of two interlocked halves, as discussed below, in connection with FIGS. 6A–6E.

In operation, at least one of the upper knife blades 76 will be cooperating with an associated lower knife blade 72 to form at least one rotary knife pair which cuts material passing through the finish trimming unit 40. Generally, the finish trimming unit will be in one of two orientations. Either both upper knife blades 76 will be associated with the outer lower knife blades 72 to form two knife pairs for severing the paper P into thirds or only one of the upper knife blades 76 will be associated with a lower knife blade 72 forming a single knife pair for cutting the paper in half.

The present invention allows for easy repositioning of the upper knife blades through operation of the pneumatic cylinders 84 and 86. The pneumatic cylinders 84 and 86 may be appropriately coupled to a central controller to allow the system to automatically change between various setup arrangements.

Figure 6A:
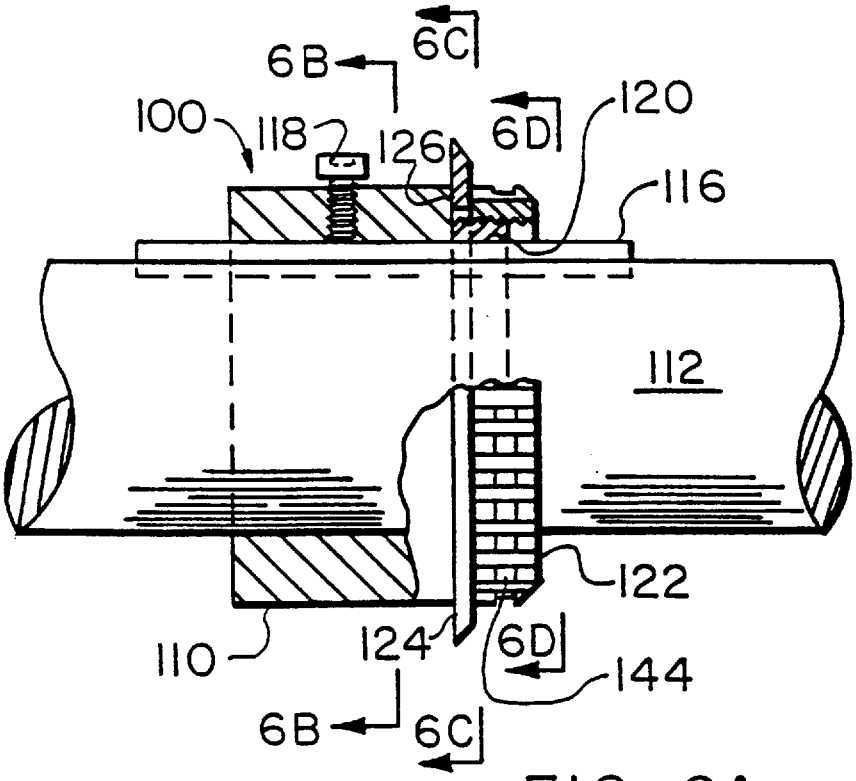
FIG. 6A is a partial section of a split ring knife assembly according to the present invention.

FIG. 6A illustrates a split ring knife assembly 100 according to the present invention. The knife assembly 100 can be utilized for the knife units 22, 24, 30 and 32 of the preliminary trimming unit 20. However, the knife assembly 100 has broader applicability to any knife assembly in which quick blade replacement would be desired.

The knife assembly 100 includes a hub 110 received on a shaft 112. The hub 110 is prevented from rotation relative to the shaft 112 by a keyway 114 receiving a key 116 of the shaft 112. A locking set screw 118 is positioned on the hub 110 overtop of the keyway 114. This set screw 118 can be tightened against the key 116 to prevent movement of the hub 110 along the axis of the shaft 112. The positioning of the set screw 118 over top of the keyway 114 will help preserve the life of the shaft 112. Should the set screw 118 damage the key 116, the key 116 of the shaft 112 can be replaced at minimal cost. This provides a distinct advantage over prior art systems which position a set screw of a hub to engage an associated shaft.

The hub 110 includes an exterior threaded cylindrical portion 120 upon which a retaining ring 122 is threaded. The retaining ring 122 clamps a split knife blade 124 between the retaining ring 122 and a shoulder 126 of the hub 110.

Figure 6B:
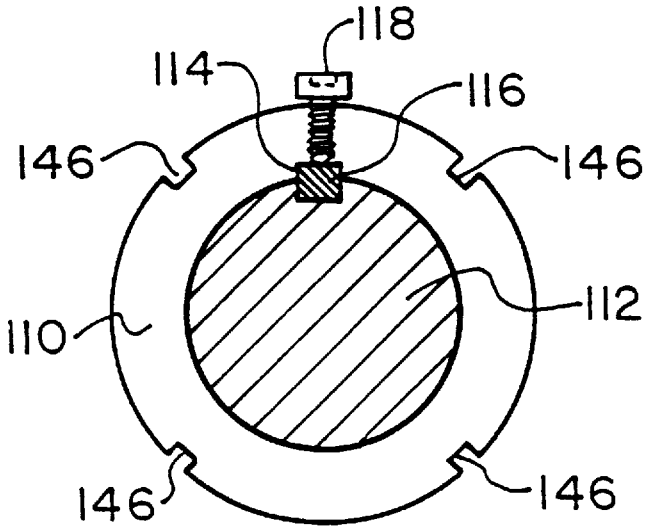
FIG. 6B is a section of the split ring knife assembly of FIG. 6A taken along line 6B—6B.
Figure 6C:
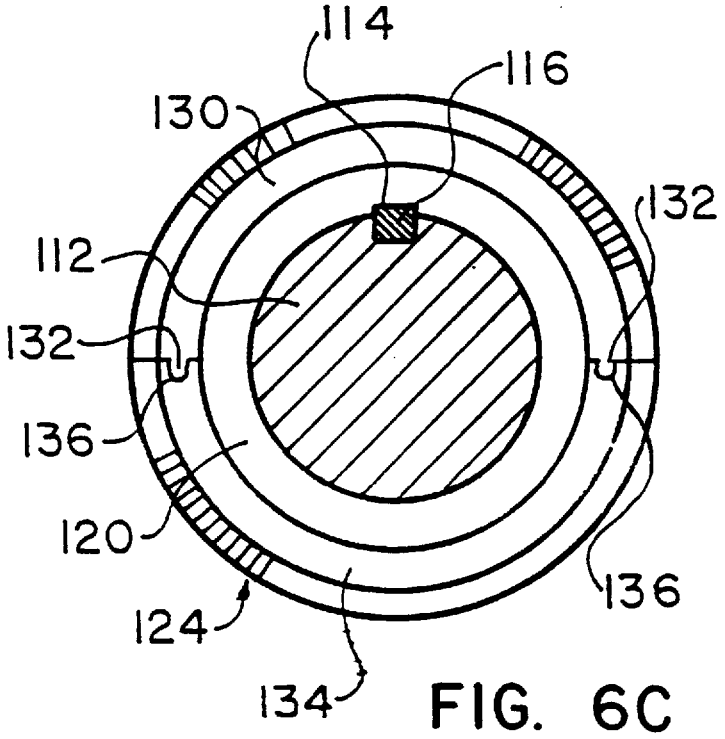
FIG. 6C is a section of the split ring knife assembly of FIG. 6A taken along line 6C—6C.

As shown in FIG. 6C, the split knife blade 124 is formed of a first circular portion 130 having engaging projections 132 on opposed ends thereof and a second interlocking circular portion 134 having recesses 136 on opposed ends thereof which are configured identical to the engaging projections 132.

Figure 6D:
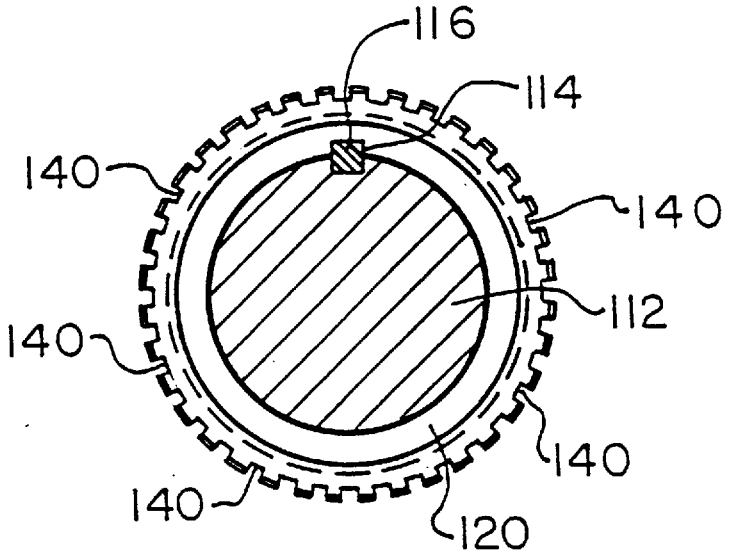
FIG. 6D is a section of the split ring knife assembly of FIG. 6A taken along line 6D—6D.

The retaining ring 122, as shown in FIG. 6D, includes a plurality of notches 140 spaced 10° apart from each other around the periphery of the retaining ring 122. The notches 140 allow for engagement of a spanner wrench with the retaining ring. The positioning of the notches at 10° increments around the periphery of the retaining ring 122 maximizes the movement of the spanner wrench on the retaining ring under limited access conditions. The retaining ring 122 has a beveled outer edge, shown in FIG. 6A, serving as indicia to indicate the specific orientation of the retaining ring onto the associated cylindrical portion 120. Depending on the intended rotation direction for the knife assembly 100, the threads provided on a threaded cylindrical portion 120 of the hub 110 may be reverse threaded, thereby preventing the retaining ring 122 and clamped split knife blade 124 from becoming loose during rotation of the shaft 112. Where the threads on the threaded cylindrical portion 120 are reverse threaded or left-hand threaded, the corresponding retaining ring 122 will contain a circumferential groove 144 therearound. The groove 144 serves as an indicia to indicate the presence of left-handed or reverse threads.

The hub 110 additionally includes locking grooves 146 or notches positioned at 90° increments about the periphery thereof shown in FIG. 6B. The locking grooves 146 provide position for engagement of a spanner wrench on the hub 110. The shaft 112 and hub 110 can be held in position by a first spanner wrench engaging the locking grooves 146 while a second spanner wrench is used to tighten or loosen the retaining ring 122 through engagement of notches 140. The locking grooves 146 need only be positioned at 90° increments since a spanning wrench will only be used to engage and hold the hub 110.

In operation, when the split knife blade 124 needs replacement, the retaining ring 122 is loosened to a position sufficient to allow the first circular portion 130 to be disengaged from the second circular portion and the split knife blade 124 thereby removed and an appropriate new knife blade 124 inserted. The first and second portions of the new knife blade 124 will be interlocked into position around the shaft 112. The retaining ring 122 will then be tightened to clamp the new split knife blade 124 in a position between the retaining ring 122 and the shoulder 126. It is preferred that the threaded cylindrical portion 120 extend sufficiently far such that the retaining ring 122 can be loosened to a point where the first and second portions 130 and 134 of the knife blade 124 can be disengaged from each other with the retaining ring 122 still threaded onto a portion of the threaded cylindrical portion 120. This configuration will minimize the knife replacement time by not requiring the retaining ring 122 to be rethreaded onto the threaded cylindrical portion 120. As discussed above, appropriate spanner wrenches can be used to hold the hub 110 and shaft 112 in place and to loosen or tighten the retaining ring 122.

Figure 6E:
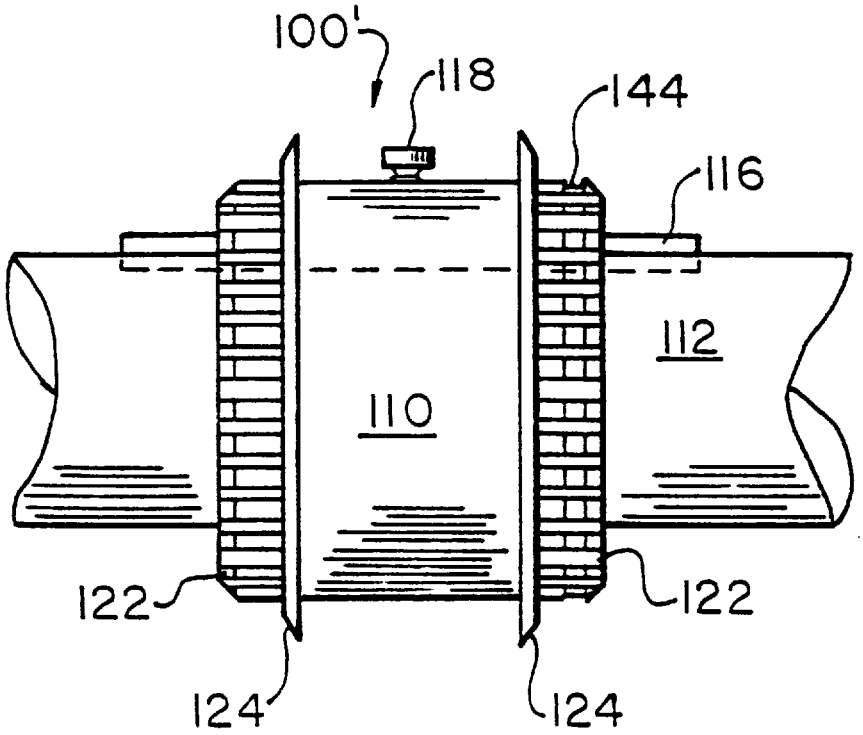
FIG. 6E is a side view of a second split ring knife assembly according to the present invention.

FIG. 6E illustrates a second split ring knife assembly 100' according to the present invention. The knife assembly 100' is substantially identical to the knife assembly 100 disclosed in FIGS. 6A–6D, discussed above, except that two threaded cylindrical portions 120 are provided on either end of the hub 110 to secure a split knife blade 124 at either end thereof by an associated retaining ring 122. It should be noted that one side of the knife assembly 100' is required to be reverse threaded, as identified by the circumferential groove 144 within the associated retaining ring 122. The modified knife assembly 100' provides for a dual knife assembly on a single hub 110. The split ring knife assemblies 100 and 100', according to the present invention, provide distinct advantages over the prior art by providing for quick, easy replacement of the knife blades 124. Additionally, the knife assemblies 100 and 100' are designed to allow for changing of the knife blades 124 in a limited access situation. Furthermore, the knife assemblies 100 and 100' of the present invention are specifically designed to minimize marring of the associated shaft 112 upon which they are received. These and other advantages of the present knife assemblies make the present invention applicable for a wide variety of uses.

Figure 7:
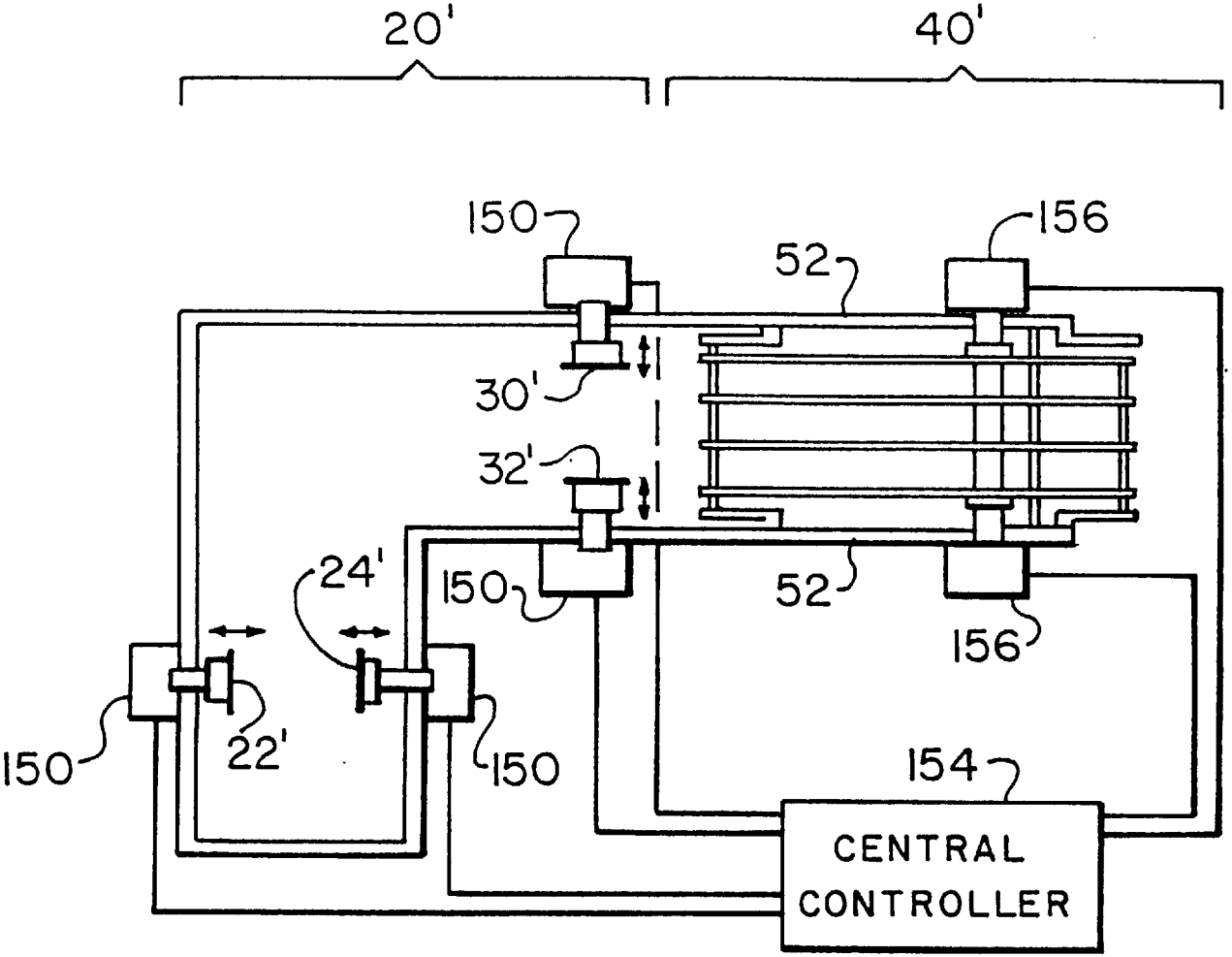
FIG. 7 schematically illustrates a top view of a preliminary trimming unit and a finish trimming unit of the automatic trimming unit according to a second embodiment of the present invention.

FIG. 7 schematically illustrates a top view of a preliminary trimming unit 20' and a finish trimming unit 40' of an automatic trimming unit according to a second embodiment of the present invention. The vacuum tube assembly 28 has been omitted for clarity. The preliminary trimming unit 20' and the finish trimming unit 40' have been combined into an integral machine. The side frames 52 of the finish trimming unit 40' are formed integral with the frame of the preliminary trimming unit 20'. The finish trimming unit 40' is substantially identical to the finish trimming unit 40 described above. The preliminary trimming unit 20' differs from the preliminary trimming unit 20 disclosed in FIG. 2 in that the knife pairs 22', 24', 30' and 32' are provided to be independently adjustable. As discussed in connection with FIG. 2, each knife pair includes an upper knife positioned above the paper to be severed and an associated lower blade (not shown) mounted below the paper to be severed. Each associated knife pair 22', 24', 30' and 32' is automatically adjusted to the appropriate position by a controller 150 such as by control of a pneumatic or hydraulic piston, feed screw or conventional linear reciprocating controller. The controllers 150 of each knife pair 22', 24', 30' and 32' are coupled to a central controller 154. Additionally, controllers 156 are provided on the finish trimming unit 40' to control the pneumatic cylinders 84 and 86 of each upper knife blade 76. The controllers 156 are also coupled to the central controller 154. The central controller 154 provides for automatic adjustment of the first knife 22', second knife 24', third knife 30' and fourth knife 32' of the preliminary trimming unit 20' and the position of the upper knife blades 76 of the finish trimming unit 40'. The central controller 154 allows for complete automation of the entire process. The automatic trimming unit disclosed in FIG. 7 operates in the same manner as described above.

It will become apparent to those of ordinary skill in the art that various modifications may be made to the present invention without departing from the spirit and scope thereof. Consequently, the intended scope of the present invention is to be defined by the following claims.

I claim:

1. A trimming system for a web press comprising:

a paper perforation means for perforating a web of paper along a folding line;

a means for cutting said web of paper into individual paper sheets;

a paper folding means for folding the paper along the folding line forming a backbone along a first side of the folded paper;

a preliminary trimming unit for trimming the folded paper, said preliminary trimming unit including a plurality of knife means adapted to trim four sides of said folded paper, including said backbone; and a finish trimming unit receiving the preliminarily trimmed paper from said preliminary trimming unit and adapted to cut the preliminarily trimmed paper into distinct products.

2. The trimming system of claim 1 further including a means for removing the severed backbone of said folded paper which is removed from said folded paper by one of said plurality of knife means, wherein said means includes plastic tubing connected to a vacuum source wherein said plastic tubing forms an angle of less than 45° with respect to the horizontal, and wherein said preliminary trimming unit includes a substantially 90° turn in the direction of transportation of the folded paper between at least two of said plurality of knife means.

3. The trimming system of claim 1 wherein said finish trimming unit includes:

a frame;

a feeding means mounted on said frame for transporting the preliminarily trimmed paper through said finish trimming unit;

a lower knife shaft mounted on said frame below the path of the paper through said finish trimming unit;

a plurality of lower knife blades attached to said lower knife shaft at spaced locations;

an upper knife shaft mounted on said frame above the path of the paper;

at least one upper knife blade adjustably positioned on said upper knife shaft;

a driving means for driving said upper knife shaft and said lower knife shaft; and a knife positioning means for positioning said at least one upper knife blade along said upper knife shaft to cooperate with selective lower knife blades of said plurality of lower knife blades to form at least one knife pair adapted to cut the paper.

4. The trimming system of claim 1 wherein at least one of said knife means includes a knife blade having two separable interlocking circular sections.

5. The trimming system of claim 4 wherein each said knife blade having two separable interlocking circular sections is formed with a knife blade assembly including:

a hub with a keyway therein, said hub configured to be positioned on a rotary shaft, said shaft including at least one threaded cylindrical portion, a plurality of locking notches, and a shoulder adjacent said cylindrical portion, said knife blade positioned on said cylindrical portion, and a retaining ring threadably received on said cylindrical portion for clamping said two interlocking circular sections of said nut blade in position between said shoulder and said retaining ring, wherein said retaining ring includes a plurality of notches positioned about the periphery thereof.

6. The trimming system of claim 5 wherein said notches around each said retaining ring are spaced about 10° apart from each other around the periphery of said retaining ring.

7. A finish trimming unit for trimming of individual paper products comprising:

a frame;

a feeding means mounted on said frame for transporting the paper products to be trimmed through said finish trimming unit, said feeding means including a plurality of opposed driving belts for engaging opposed sides of the individual paper products;

a lower knife shaft mounted on said frame below the path of the paper products to be trimmed through said finish trimming unit;

a plurality of lower knife blades attached to said lower knife shaft at spaced locations;

an upper knife shaft mounted on said frame above the path of the paper products;

at least one upper knife blade adjustably positioned on said upper knife shaft;

a driving means for driving said upper knife shaft and said lower knife shaft; and a knife positioning means for positioning said at least one upper knife blade along said upper knife shaft to cooperate with selective lower knife blades of said plurality of lower knife blades to form at least one knife pair adapted to cut the paper products to be trimmed, said knife positioning means including a knife shaft lifting mechanism attached to said upper knife shaft for lifting said upper knife shaft to a knife adjustment position, and said knife positioning means including a knife blade moving mechanism attached to each said upper knife blade for adjusting the position of the upper knife blade on said upper knife shaft when said upper knife shaft is in said knife adjustment position.

8. The trimming unit of claim 7 wherein said knife shaft lifting mechanism includes at least one pneumatic cylinder attached to said upper knife shaft adapted to lift said upper knife shaft to a knife adjustment position; and said knife blade moving mechanism includes at least one pneumatic cylinder attached to each said upper knife blade to adjust the position of said upper knife blade on said upper knife shaft when said upper knife shaft is in said knife adjustment position.

9. The trimming unit of claim 8 wherein each said knife blade moving mechanism includes a pair of said pneumatic cylinders attached to each said upper knife blade, with said pair of pneumatic cylinders attached to each said upper knife blade on opposed sides of said upper knife shaft, and wherein said at least one pneumatic cylinder of each said upper knife blade is adapted to maintain an engagement pressure on said upper knife blade during the cutting of the material to be trimmed to maintain an engagement between said upper knife blade and said cooperating lower knife blade.

10. The trimming unit of claim 7 wherein a pair of said upper knife blades and three said lower knife blades are provided, wherein said feeding means includes a plurality of spaced upper and lower drive belts, and wherein said frame includes supporting leg members with adjustable height means and castors supporting said leg members.

11. A method of trimming printed articles from a web press comprising:

a) perforating a web of paper along a folding line and cutting said web of paper into individual paper sheets;

b) folding said paper along said folding line forming a backbone along a first side of said folded paper;

c) cutting said backbone and remaining three sides of said folded paper with a preliminary trimming unit;

d) feeding said trimmed paper to a finish trimming unit; and e) cutting said folded, trimmed paper into distinct products in said finish trimming unit.

* * * * *